United States Patent [19]

Tabayashi

[11] 4,194,832

[45] Mar. 25, 1980

[54] CONSECUTIVE COPYING AND BOOKBINDING METHOD AND ITS APPARATUS

[75] Inventor: Seiichi Tabayashi, Tokyo, Japan

[73] Assignee: Toppan Printing Co., Ltd., Tokyo, Japan

[21] Appl. No.: 865,784

[22] Filed: Dec. 30, 1977

[51] Int. Cl.[2] ..... G03G 15/00

[52] U.S. Cl. ..... 355/11; 430/394; 430/78; 430/97; 281/21 R; 355/23

[58] Field of Search ..... 355/3 R, 14, 16, 13, 355/11, 23, 25, 26, 24; 96/1 R; 281/21 R

[56] References Cited

U.S. PATENT DOCUMENTS

| | | | |
|---|---|---|---|
| 3,210,093 | 10/1965 | Steidinger | 281/21 R |
| 3,580,670 | 5/1971 | Bhagat | 355/23 X |
| 3,775,102 | 11/1973 | Punnett | 355/3 R X |
| 3,793,016 | 2/1974 | Eichorn | 355/3 R X |
| 3,865,480 | 2/1975 | Swanberg | 355/3 R |
| 3,917,400 | 11/1975 | Rodek et al. | 355/14 X |

*Primary Examiner*—R. L. Moses

*Attorney, Agent, or Firm*—Bacon & Thomas

[57] ABSTRACT

Images of a microfilm on which images of the pages of a book are recorded are alternately and successively formed on an electrophotographic member for printing the obverse surface of a web and on another electrophotographic member for printing the reverse surface of the web. Then, these images formed are transferred and fixed onto the obverse and reverse surface of the web, thereby to complete printings of the respective pages of the book. Finally, the web with the printed images is folded at an interval of one page and the folded web is cut and bound. A consecutive copying and bookbinding apparatus comprises an electrophotocopying apparatus disposed on an image projection path of a microfilm projector provided with projection path changing mirror. Another electrophotocopying apparatus is disposed on a projection path normal to the aforesaid projection path. Rollers are provided to continuously feed the web past these electrophotocopying apparatuses. A folder folds the web with the images printed on both the surfaces at an interval of one page and a binder binds the folded web.

13 Claims, 5 Drawing Figures

| | | | | | | | | | | |
|---|---|---|---|---|---|---|---|---|---|---|
| 1 | 4 | 5 | 8 | 9 | 12 | 13 | 16 | 17 | n-3 | n |

| | | | | | | | | | | |
|---|---|---|---|---|---|---|---|---|---|---|
| 2 | 3 | 6 | 7 | 10 | 11 | 14 | 15 | 18 | n-2 | n-1 |

| | | | | | | | | | | | | | |
|---|---|---|---|---|---|---|---|---|---|---|---|---|---|
| 1 | n-9 | 4 | n-6 | 5 | n-5 | 8 | n-2 | 9 | n-1 | 12 | 2 | 13 | 3 |

CONSECUTIVE COPYING AND BOOKBINDING METHOD AND ITS APPARATUS

BACKGROUND OF THE INVENTION

The present invention relates to a bookbinding method and its apparatus by using an electrophotocopying apparatus.

Generally, books are manufactured through many and complex steps including plate-making, printing, bookbinding and the like. Accordingly, the book manufacturing cost of one book is relatively high, when a relatively small number of books, for example, several hundreds books, are manufactured. For this, reason it is desirable to minimize the manufacturing steps and transferring of books during manufacture and, if possible, to automate its process under a computer control, for example. Many attempts to improve book manufacturing such as reduction of manufacturing cost and speed-up of bookbinding, have been made of which the following approaches are exemplary.

Firstly, a camera speed plate is engraved and the engraved plate is automatically loaded into a small type printing machine and then is subjected to printing, gathering and bookbinding steps. Secondly, by using a copying machine, an original paper is copied onto a usual paper and then it is subjected to the gathering and bookbinding steps. Thirdly, resin reliefs are prepared, arranged in a belt fashion and then printed and bound. However, these approaches suffer from many disadvantages. For example, the original paper must be manually exchanged. The plate member is costly with low printing quality.

SUMMARY OF THE INVENTION

An object of the present invention, accordingly, is to provide a consecutive copying and bookbinding method and apparatus for practicing the method by which a relatively small number of books may be manufactured cheaply and rapidly.

According to one aspect of the present invention, there is provided a consecutive copying and bookbinding method comprising the steps of: projecting at least an image for the obverse surface of a web in a microfilm of which each frame records thereon an image of one page of a book and which records thereon at least images of one book on an endless electrophotographic plate, and transferring and fixing the projected image on the obverse surface of the web according to an electrostatic latent image transferring method; projecting at least one image on the reverse surface of the web in the microfilm on another endless electrophotographic plate and transferring and fixing the projected image on the reverse surface of the web according to an electrostatic latent image transferring method; successively folding the web with images fixed at a interval of one page after said steps have been repeated; and then cutting the final page of the book and binding the folded web.

According to another aspect of the present invention, there is provided a consecutive copying and bookbinding apparatus for practicing the method, which apparatus comprises a projector for projecting an image oe one page of a book which is recorded on a microfilm at an interval of one frame; a reflective projecting device for projecting the projection of the microfilm in two directions; a first photosensitive member for forming an electrostatic latent image for the obverse surface of a web, the first member being provided on one of the projection paths; a first developer for developing the latent image and transferring and fixing the latent image on the obverse surface of the web; a second photosensitive member for forming an electrostatic latent image for the reverse surface of the web, the second member being provided on the projection path; a second developer for developing the latent image and transferring and fixing the latent image on the reverse surface of the web; a feeder for successively feeding the web to the first and second members; and a folder for folding the web with images fixed at an interval of one page, and a binder for binding the folded web.

DETAILED DESCRIPTION OF THE PREFERRED EMBODIMENT

The present invention will be described by using a preferred embodiment with reference to the drawings.

Figure 1:
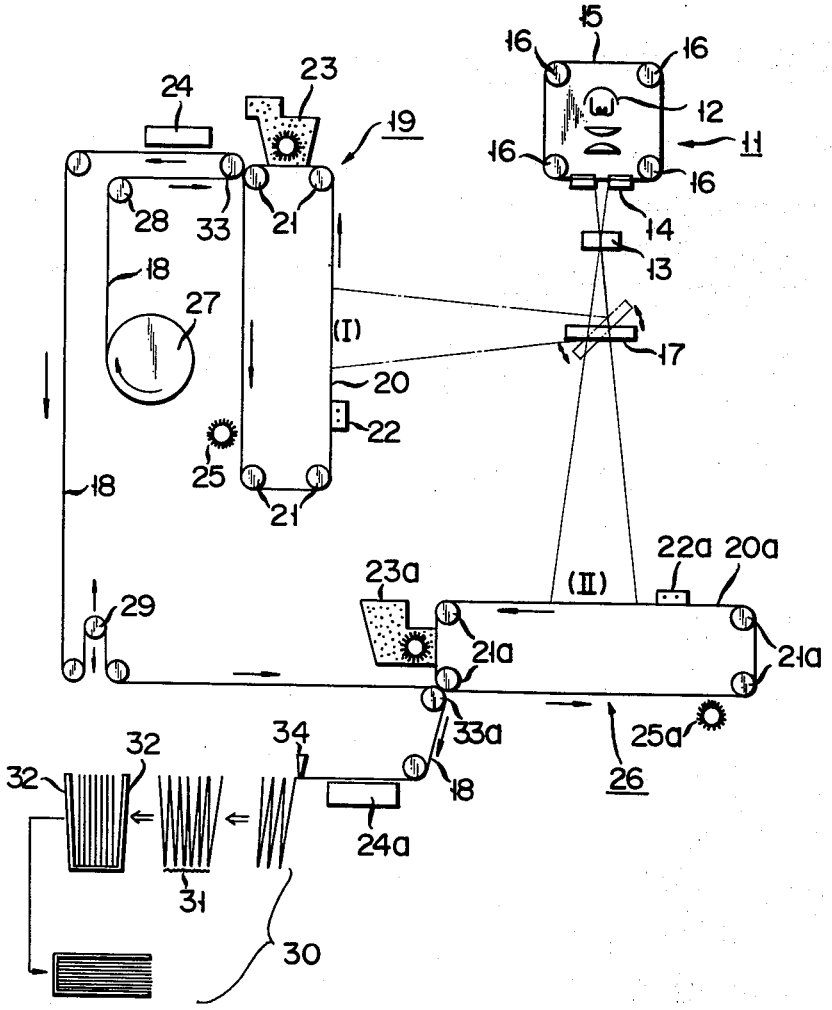
FIG. 1 is a schematic view of a consecutive copying and bookbinding apparatus according to the present invention.

In FIG. 1, reference numeral 11 designates a conventional projector comprising a light source 12, a lens 13, a film gate 14, and a condenser. The projector is designed so as to permit an endless microfilm 15 to be loaded into it. Each frame of the endless microfilm has an image of one page of books to be bound. The microfilm loaded is movable to a predetermined position of the film gate 14 disposed between the light source 12 and the lens 13, through rollers 16. A half-mirror 17 is disposed midway of the projection from the projector 11. The half-mirror 17 is rotatable by 45°, for example, so that it permits the image projection to straightfordly progress or to turn the image projection by 90° from its straight course when it is rotated by 45°. As is known, a common mirror or a prism may be used for changing the projection course in two directions, instead of the half-mirror.

An electronic copying machine 19 is used for copying the image of the microfilm on the surface, i.e. one of the surfaces of a web 18 is provided on the projection course turned by 90° when the half-mirror 17 is rotated by 45°, as shown. With this arrangement, a light pattern projected from the projector 11 illuminates a photosensitive member 20 to form an electrostatic latent image corresponding to the light pattern on the member 20. Generally, the photosensitive member 20 is constructed as an endless belt with photo-conductive insulating material coated thereon, and is driven by rollers 21. More specifically, the photosensitive member 20 is such that a film such as a thin aluminum plate or a polyester film is laminated with an aluminum film to form a sheet durable for repeated use, and the thus fabricated sheet is coated with a photosensitive layer made of selenium, zinc oxide, phthalocyanine derivative, copper phthalocyanine with a type crystal form, or the like. These photosensitive materials are suitable particularly for the present invention since they are durable for a long time printing use and have excellent sensitivity. A charging unit 22 is disposed upstream of and close to the projected portion of the photosensitive member 20. The charging unit 22 is, for example, a corona charging device and charges the photosensitive member 20 positive or negative. With relation to the just-mentioned expression "upstream," the photosensitive member 20 travels in a direction indicated by an arrow, as shown. The charged photosensitive member 20 passes the projected portion where it has an electrostic latent image corresponding to the light pattern projected and further travels in the arrow direction to reach a developer 23 where the latent image formed is visualized in a suitable known manner. Some of the known development approaches include powder cloud development to form visible image with cloud of powder, and a cascade development to visualize the electrostatic latent image by charging toner through friction. The visible image on the photosensitive member 20 leaving the developer 23 is transferred onto a web 18 by a roller 33 and then is fixed by a fixing device 24 with a heating means. Then, the photosensitive member 20 continues its travel to reach a cleaning device 25 where the residual toner remaining on the untransferred portion of it is removed. The cleaning device 25 is formed by a brush made of, for example, rabbit's fur which attracts the toner.

When the half-mirror returns to the original state, i.e. it is disposed normal to the optical axis of the projector 12, light rays including image information straightforwardly travels towards another electronic copying machine 26 which is spaced from the half-mirror 17 with the same distance as the electronic copying machine 19 is spaced therefrom. The copying machine 26 is used to copy an image on the succeeding page of the book on the reverse surface of the web 18 of which the obverse surface has the fixed image formed by the copying machine 19. The electronic copying machine 26 may be constructed with the same construction and function as of the copying machine 19. For this, elaboration of the machine 26 will be omitted with attaching a character "a" to the respective reference numerals of the copying machine 19. For example, "20*a*" designates the part corresponding to the one designated by 20 in the copying machine 19.

The web 18 is fed from a paper roll 27 to the electronic copying machine 19 and, through a dancer roll 29, supplied to the copying machine 26 and finally to a bookbinding apparatus 30. As shown, the web is inversed at the dancer roll 29 and supplied to the copying machine 26. The dancer roll is used to adjust the distance between a first image transfer position for transferring the image onto the obverse surface of the web 18 to a second image transfer position for transferring the image onto the reverse surface. The adjustment of the distance is made by vertically moving the dancer roller 29. In the figure, reference numeral 34 designates a cutter for cutting the end of the final page.

A bookbinding apparatus 30 may be any type bookbinding machine if it is not contradictive to the object of the present invention. For example, in the case of an ideal binding machine, it generally comprises a folding stage, back lining stage, a cover jacketing stage and a three-side trimmer. The folding stage consecutively folds a web of paper and cuts the folded paper to make a book. The zigzag or parallel type folding is generally employed for the folding, although in this example, the zigzag type folding is employed. In the back lining stage, the back of the gathered leaves is coated with adhesive of hot melting type. In the cover jacketing stage, covers are attached to the backed and gathered leaves by adhesive. The three-side trimmer finishes the bookbinding by cutting three sides; top edge, tall edge and fore edge. If a searching processor (not shown) is used relating to the projector 11, and searches the marks attached to the microfilm 15, the entire process of bookbinding and copying may be automatically controlled by using a computer.

The explanation to follow is a consecutive copying and bookbinding method according to the present invention.

The microfilm 15 of which each frame records the image included in one page of the book to be bound is loaded at a predetermined position of the film gate 14 of the projector 15 and the magnification of the lens 13 is adjused so as to focus the lens into a given position of the photosensitive member 20. At this time, the half-mirror 17 is fixed with inclination at 45° so that the light rays from the light source 12 of the projector 11 are deviated to impinge upon the surface of the photosensitive member 20. The photosensitive member 20 travels in the arrow direction under the charging unit 22 where it is charged positive or negative by corona discharging and stops at the position subjected to the light projection from the light source 12 via the half-mirror 17 where it is exposed to the light rays including the image information of the microfilm 15 to form an electrostatic latent image thereon. After completion of the latent image formation, the photoconductive member 20 further moves to reach the development device 23 where it is developed by toner and then at the roller 33, the developed image is transferred onto the web 18 fed from the paper roll 27. The transferred image on the web 18 is fixed by the fixing apparatus 24. After passing through the image transferring stage, the photosensitive member 20 enters the cleaning stage where the residual toner on the member 20 are cleaned by the cleaning device 25, for the preparation of the succeeding charge thereof.

The paper 18 with the transferred and fixed image moves through the dancer roller 29 where its feeding pitch is controlled, to enter the second image transferring stage where the image of the succeeding page of the book is transferred onto the reverse side of the web 18. As a matter of course, the second image transfer stage is a part of the second copying operation which is performed by the second copying machine 26. In the second copying operation, the half-mirror 17 is returned from the 45° inclination state to the original state that it is fullface directed to the projector 11, in order that the image of the microfilm correctly projects onto the photosensitive member 20*a*. Then, similar copying steps such as charging, exposure, development, and cleaning are performed through the charging unit 22*a*, the development device 23*a*, the fixing apparatus 24*a* and the cleaning apparatus 25*a*.

The length of the web 18 between the first and second image transfer positions, i.e. rollers 33 and 33*a*, is roughly adjusted as to be an integer multiple of the pitch of one page and further adjusted finely by the dancer roll 29. The fine adjustment of the web path by the dancer roller 29 must be changed for the respective sizes of the books. However, this is not so serious problem if the movement distance of the dancer roll 29 is previously set depending on the sizes of the books.

The web 18 with images on the obverse and reverse surfaces is directly fed into the folding stage where it is folded in zigzag fashion, as shown in FIG. 1. As the folding progresses, a detector detects the end mark on the final page to drive the cutter 34 to cut the web 18. Alternately, a counter may be used instead of the detector. In this case, the counter is installed with relation to the folding machine and when the counting value reaches a predetermined value, a drive signal is applied to the cutter 34 for driving it.

Any other folding method may be applied to the consecutive copying and bookbinding method as disclosed, for example, in "Book Production Industry And Magazine Production," (1976, November), page 43–, title: "New Wood Production System Features Horizontal Web." For example, separate leaves of one book may be gathered or the parallel folding method may be used. Additionally, a folding machine of the conventional rotary press may be used with a multipage copy that a plurality of pages are optically recorded on a single frame of the microfilm or are projected for a single exposure of the microfilm. In this case, the apparatus is bulky and the width of the web is wide. However, this method is effective for the bookbinding of the book having a large number of pages or a large number of lots. The folded paper is fed to the back lining stage, the cover jacketing stage, and three-side trimmer, where it is backed by using adhesive, covered and cutting for finishing. It is to be noted that the bookbinding method thus far mentioned is only an example and thus any suitable conventional approach is usable as occasion needs.

Figures 2, 3A, 3B, 4:
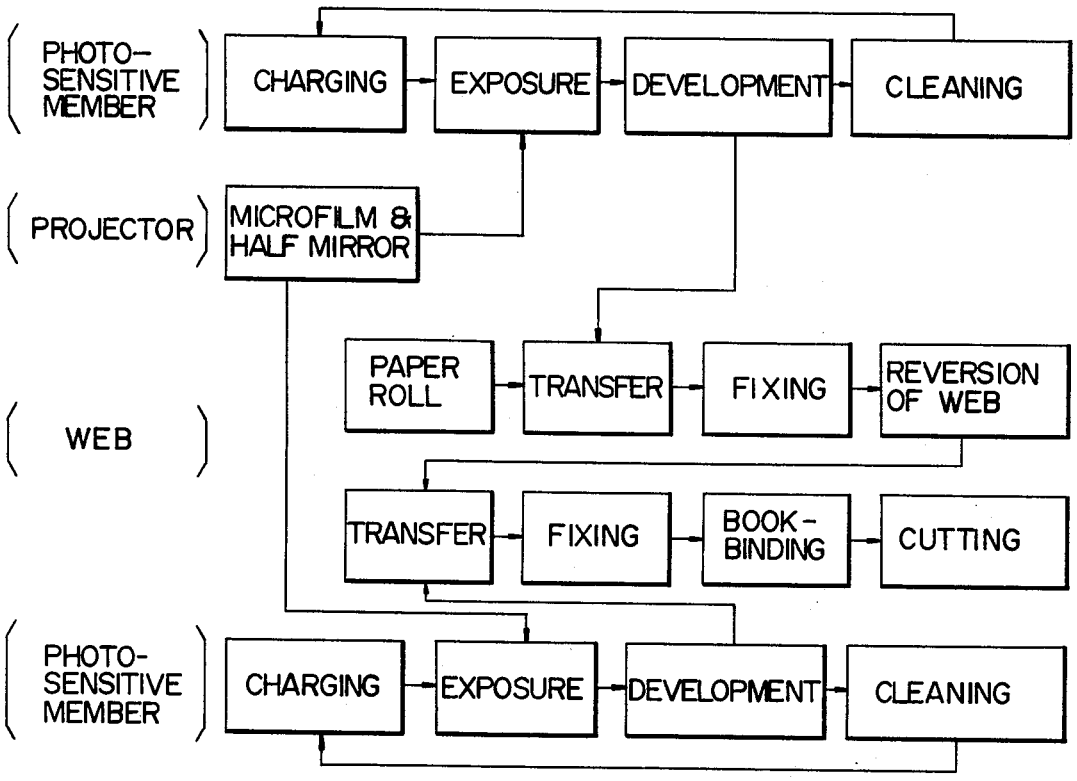
FIG. 2 shows a flow chart illustrating one of the consecutive copying and bookbinding methods according to the present invention.
FIG. 3A shows an arrangement of pages to be printed on the obverse surface of a web.
FIG. 3B shows the same on the reverse side.
FIG. 4 shows pages on the respective frames of the microfilm.

FIG. 2 illustrates a flow chart of the consecutive copying and bookbinding method according to the present invention. This flow chart is illustrated mainly with respect to the photosensitive member 20, the projector 11, the web 18, and the photosensitive member 20*a*.

The explanation to follow is the microfilm searching performed when the photosensitive members 20 and 20*a* are exposed by the projector 11. Various conventional methods may be used for the searching of the microfilm.

The web with successive images transferred on the obverse and reverse surfaces is paged as shown in FIGS. 3A and 3B; 1, 4, 5, 8 . . . pages are paged on the obverse surface and 2, 3, 6, 7 . . . on the reverse surface. The dance roller 29 is so adjusted that the reverse surface of the web 18 is subjected to the image transfer after five pages since the image is transferred onto the obverse surface thereof. The frames of the microfilm 15 are arranged as shown in FIG. 4. The half-mirror 17 is alternately rotated by 45° in synchronism with the frame transfer of the microfilm 15. The projection by the projector 11 is reciprocately moved between the positions I and II, so that the obverse and reverse surfaces of the photosensitive member 20 are alternately exposed. In FIGS. 3A and 3B, numerals indicate page number and "n" which is the final page of the book to be bound. Codes for searching the frame is marked on at the centers of the blanks on the top and bottom of each frame. The codes are detected by a detector (not shown) within the projector 11. The center of the frame is adjusted to coincide with the optical axis of the projector 11, through the detection by the detector. After the first page frame of the microfilm is set at the desired position of the projector, the exposure of the photosensitive member 20 is initiated. After completion of the exposure, the microfilm is shifted in a direction and the codes of the n-9 page are detected by the detector. The center of the frame corresponding to the n-9 page is positioned at the optical axis of the projector 11 by the detection of the detector. At the same time, the half-mirror 17 is rotated by 45° to shift the exposure position from I to II. Succeedingly, this operation will be repeated for preparation of the ensuing exposure of the photosensitive members 20 and 20*a*. An end mark is recorded on the final portion of the microfilm 15. When the picture transfer of one book is completed, the end mark is detected by the detector. Upon the detection of the end mark, the cutter is driven to cut the web 18 at a given position. The detection is performed in synchronism with the counter for indicating the necessary number of books. More precisely, the counter counts down every detection of the end mark and therefore when the contents of the counter is reduced to be 0, it indicates the end of the exposure. The endless microfilm may be formed, for example, by connecting both the ends of the microfilm by a transparent adhesive tape when the microfilm is set to the projector 11.

When the frames of the microfilm 15 can not be edited in the exposure order, the order of the exposure is previously recorded in a card or tape and the signal read out from it is used to shift the microfilm 15 to search a necessary frame. For example, assume that the frame previously exposed is the Mth frame and the next frame to be exposed is the Nth frame. If $M<N$, the microfilm is shifted toward the N by the distance of $N-M$ and if $M>N$, it is shifted toward the same by the distance of $M-N$. The number of the frames is detected by the detector and when it detects that frame number reaches aa necessary amount of movement, it transmits a signal to a drive motor to stop its operation. In this manner, the necessary frame is positioned at the desired position of the film gate 14.

As described above, an endless microfilm roll is used as an original plate so that exchange of the original plate and search thereof are easily made. Use of an electrophotography technique which can repeatably makes an image reproduction, contributes to reduce the plate-making cost. Use of the rotatable half-mirror enables a necessary number of the page images to be automatically transferred. Further, the bookbinding process may be automated except exchange of the original plate, setting of the magnification of optical system, and the control instruction of the photosensitive member, and the feeding of the web. Accordingly, the bookbinding may be processed by the minimum number of persons. Reprint is possible in an easy manner. Thus, any number and any size of books may be bound in any necessary time.

What is claimed is:

1. A consecutive copying and book-binding method for manufacturing a book from a web and wherein individual pages of the complete book are imaged on individual frames of a microfilm, comprising the steps of:

(a) projecting an image of a frame of the microfilm on an endless electrophotographic plate, developing the latent image, transferring the image electrostatically to an obverse surface of the web at one location on the web, and fixing the image on the obverse surface of the web;

(b) projecting another image in the next frame of the microfilm on another endless electrophotographic plate, developing the latent image, transferring the other image electrostatically to a reverse surface of the web at a location displaced along the length of the web by a distance which is an integer multiple of the width of one page, and fixing the image on the reverse surface of the web;

(c) successively folding the web with the fixed images at intervals of one page after repeating steps (a) and (b) while advancing the web; and (d) cutting the final page of the book and binding the folded web.

2. A consecutive copying and bookbinding method according to claim 1, in which said images for the obverse and reverse surfaces of the web are alternately arranged on said microfilm and the image of one frame of the microfilm is alternately projected onto the obverse and reverse surfaces of the web.

3. A consecutive copying and bookbinding method according to claim 1, in which said microfilm is of an endless type.

4. A consecutive copying and bookbinding method according to claim 1, in which said microfilm has a code marked thereonto and detecting means detects said code to automatically position said microfilm.

5. A consecutive copying and bookbinding method according to claim 1, in which a code is marked on a proper position of a microfilm and said detecting means detects said code to automatically cut the final page of the book.

6. A consecutive copying and book-binding apparatus comprising:

a web having obverse and reverse surfaces for forming pages of a book;

means for projecting an image of one page of a book which is recorded on a microfilm at an interval of one frame;

means for changing the direction of the projection from the microfilm between two projection paths;

a first photosensitive member for forming an electrostatic latent image for the obverse surface of the web, said first member being positioned in one of the projection paths;

a first means for developing said latent image and for transferring and fixing a developed image on the obverse surface of the web;

a second photosensitive member for forming an electrostatic latent image for the reverse surface of the web, said second member being positioned in the other projection path;

a second means for developing said latent image and for transferring and fixing a developed image on the reverse surface of the web;

means for feeding the web successively to said first and second photosensitive members;

means for cutting the web after the pages of one book are formed thereon; and means for folding the web with fixed images at an interval of one page and for binding the folded web.

7. A consecutive copying and bookbinding apparatus according to claim 6, in which said projecting means projects images from an endless microfilm.

8. A consecutive copying and bookbinding apparatus according to claim 6, in which said projecting means is provided with means for searching the microfilm.

9. A consecutive copying and bookbinding apparatus according to claim 6, in which said projection direction changing means is a half-mirror rotatable by 45°.

10. A consecutive copying and bookbinding apparatus according to claim 6, in which said projection direction changing means is a mirror rotatable by 45°.

11. A consecutive copying and bookbinding apparatus according to claim 6, in which said photosensitive members are of an endless belt type.

12. A consecutive copying and bookbinding apparatus according to claim 6, in which said endless belt is formed by depositing a photoconductive layer made of a mixture of copper phthalocyanine and phthalocyanine derivative with $\alpha$ type crystal form on a complex film of a polyester film laminated with an aluminum film.

13. A consecutive copying and bookbinding apparatus according to claim 6, in which said paper feeding means is provided with a dancer roller for adjusting the feed of the web to said second photosensitive member said dancer roller being disposed between said first and second photosensitive member.

* * * * *